US008127929B1

(12) United States Patent
Lu et al.

(10) Patent No.: US 8,127,929 B1
(45) Date of Patent: Mar. 6, 2012

(54) PAPER PALLET FOR PACKAGING

(76) Inventors: Shang Wen Lu, Sanchong (TW); Young-Seog Kim, Seoul (KR)

( * ) Notice: Subject to any disclaimer, the term of this patent is extended or adjusted under 35 U.S.C. 154(b) by 0 days.

(21) Appl. No.: 13/069,541

(22) Filed: Mar. 23, 2011

(30) Foreign Application Priority Data

Sep. 3, 2010 (TW) ..... 99217087 U

(51) Int. Cl.
*B65D 19/00* (2006.01)

(52) U.S. Cl. ..... 206/600; 206/522; 206/592; 108/51.3; 108/56.1

(58) Field of Classification Search ..... 206/386, 206/521, 522, 591, 592, 594, 599, 600; 108/51.3, 108/54.1, 55.3, 56.1, 56.3, 57.17, 57.18, 108/57.19
See application file for complete search history.

(56) References Cited

U.S. PATENT DOCUMENTS 4,979,446 A * 12/1990 Winebarger ..... 108/51.3
(Continued)

*Primary Examiner* — Luan K Bui
(74) *Attorney, Agent, or Firm* — Chung-Ming Shih

(57) ABSTRACT

A paper pallet for packaging comprising: a load bearing base and a packaging protective frame, wherein the load bearing base is composed of a plurality of vertical supporting components and a plurality of horizontal supporting components. The load bearing base is composed of the vertical supporting components and the horizontal supporting components intersecting and subsequently interlocking with each other, and the packaging protective frame is composed of a plurality of side boards. Therefore, the side boards intersect and subsequently interlock with each other to form a packaging protective frame, which is inlaid at a set distance from the edge around the load bearing base to form a paper pallet for packaging. Thus, the paper pallet for packaging is formed by combining the packaging protective frame with the load bearing base to become the packaging box for delivering goods.

8 Claims, 8 Drawing Sheets

U.S. PATENT DOCUMENTS 5,184,558 A * 2/1993 Wozniacki ..... 108/51.3
5,357,875 A * 10/1994 Winebarger et al. ..... 108/51.3
5,487,345 A * 1/1996 Winebarger et al. ..... 108/51.3
5,568,774 A * 10/1996 Hutchison ..... 108/51.3
6,155,181 A * 12/2000 Chilcutt ..... 108/51.3
7,475,639 B2 * 1/2009 Chen ..... 108/51.3
7,726,501 B2 * 6/2010 Macqueen et al. ..... 206/600
7,905,183 B2 * 3/2011 Gibson et al. ..... 108/51.3
2011/0266177 A1 * 11/2011 Lowry et al. ..... 206/386

* cited by examiner

PAPER PALLET FOR PACKAGING

BACKGROUND OF THE INVENTION

1. Field of the Invention

The present invention relates to a paper pallet for packaging, more particularly to a load bearing base constructed by a plurality of supporting components formed by a single folded corrugated board, and a packaging protective frame being inlaid on the edge around the load bearing base, which forms a packaging box for delivering goods.

2. Description of the Related Art

When goods are sold, a packing box will be installed thereon, which can protect the surface of the goods from collision and damage. A traditional packing box structure for goods delivery uses Styrofoam as the bottom plate. Since Styrofoam is light, strong and cheap, it has been widely used for the packing box.

However, Styrofoam structure is difficult to decompose in nature, and easily produces harmful gases when burning it, which causes immense damage to the environment. If Styrofoam is not restricted or banned, a worldwide environmental crisis will be caused.

Thus, Styrofoam is politically forbidden in all countries in the world. Consequently, it is necessary to change the load bearing structure of the packing box. Currently most bearing structures are made of wood or metal frames, which are solid and able to load heavy objects onto, but their weight is too heavy and thus they weigh too much which affects the transportation and the cost thereof. Moreover, the wood or metal frames are difficult to recycle, production costs therefore remain high, and their disposal is still a major environmental issue.

Therefore, a paper pallet structure becomes a popular modern packing box structure and promotes the rapid development of paper pallets. The paper pallet structure in prior art includes paper boards with a horizontal and vertical interlaced arrangement. The horizontal and vertical paper boards are combined at lots of intersections to form a load bearer with a net shape and to provide sufficient bearing capability.

However, the paper pallet structure in prior art can only be used for stacking and moving goods, and has no special packing box structure designed for delivering goods and does not meet the requirements of being multi-functional. Therefore, the paper pallet in prior art still has lots shortcomings which need to be improved upon.

BRIEF SUMMARY

In view of the drawbacks derived from the conventional packing box, the inventor has tried hard to improve and innovate. After years of painstaking research, a new paper pallet for packaging is proposed in the present invention so as to solve the above-mentioned problems. The present invention is described below.

An object of the present invention is to provide a paper pallet for packaging, which uses a paper pallet as the load bearing base for the packing of goods, thus replacing the Styrofoam board, wood and metal frame in order to have an environmentally friendly effect and reduce the cost of using.

Another object of the present invention is to provide a paper pallet for packaging, which allows for protective packaging material to gain better protective capability for transportation.

Another additional object of the present invention is to provide a paper pallet for packaging, which uses the supporting components formed by a single folded corrugated board to form a load bearing base. A packaging protective frame is inlaid at a set distance from the edge around the load bearing base to form a paper pallet for packaging and delivering goods.

The paper pallet for packaging that can be achieved in the above mentioned purpose, includes a load bearing base and a packaging protective frame, wherein the load bearing base has a plurality of vertical supporting components and a plurality of horizontal supporting components, which are formed by a single folded corrugated cardboard, wherein the vertical supporting components and the horizontal supporting components are arranged in a net grid layout to form at least one intersection point. At the intersection point(s), a plurality of first grooves are set on the vertical supporting components which are relative to the plurality of second grooves set on the horizontal supporting components. Thus the vertical supporting components are inlaid on the horizontal supporting components, which form a load bearing base through the intersection and subsequent interlocking of these first and second grooves. The packaging protective frame is inlaid at a set distance from the edge of the load bearing base, which has a plurality of side plates arranged in a box-shape and assembled at a set distance from the edge of the load bearing base, where the plurality of side plates set a plurality of third grooves at a third intersection point for inlaying on each other so as to form the packaging protective frame, which sets a plurality of fourth grooves at a fourth intersection point for inlaying on the edge of the load bearing base to form the paper pallet for packaging.

The protective packaging material is placed between the packaging protective frame and the cargo to fill the gap between them and strengthen the protection for the cargo. The paper pallet for packaging formed by combining the packaging protective frame with the load bearing base becomes the packing box for packing large cargo when delivering. The paper pallet for packaging also has the advantages of a low manufacturing cost, light weight, no pests, etc., and can be fully recycled and is environmentally friendly.

Other features and advantages of the present invention will become apparent in the following detailed description of the preferred embodiments of the invention, with reference to the accompanying drawings, in which:

DETAILED DESCRIPTION

Figure 1:
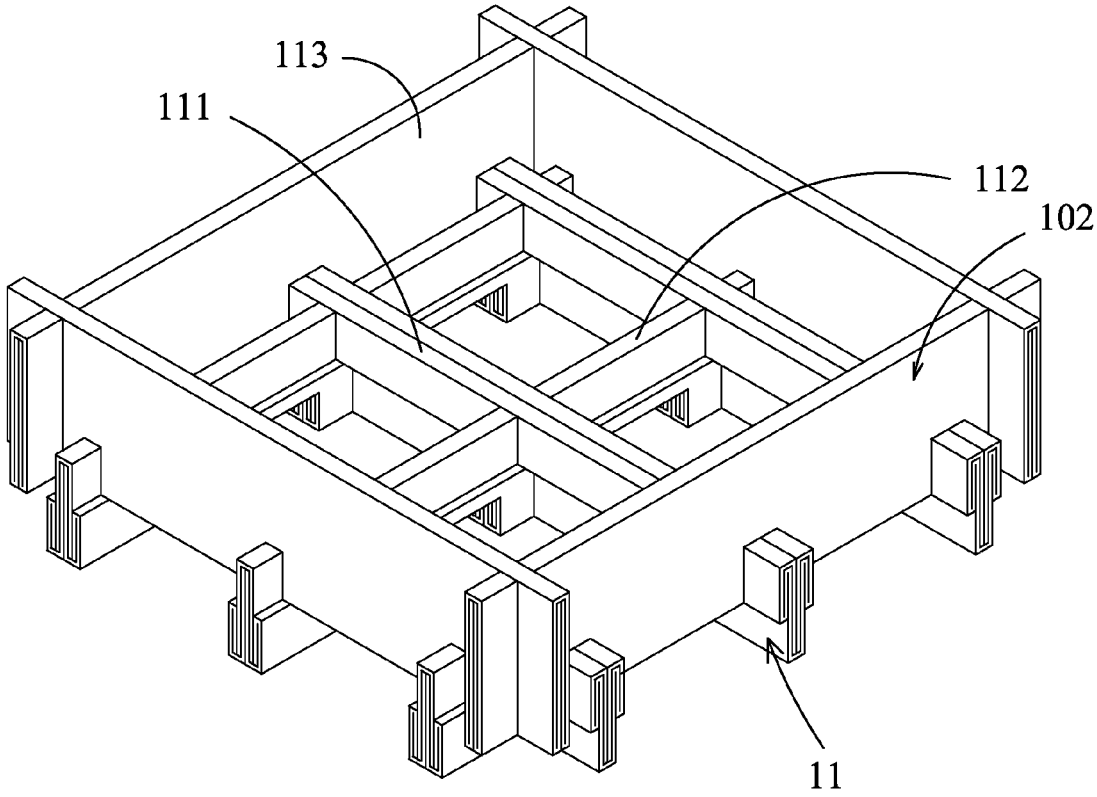
FIG. 1 is a perspective view of the present invention.
Figure 5:
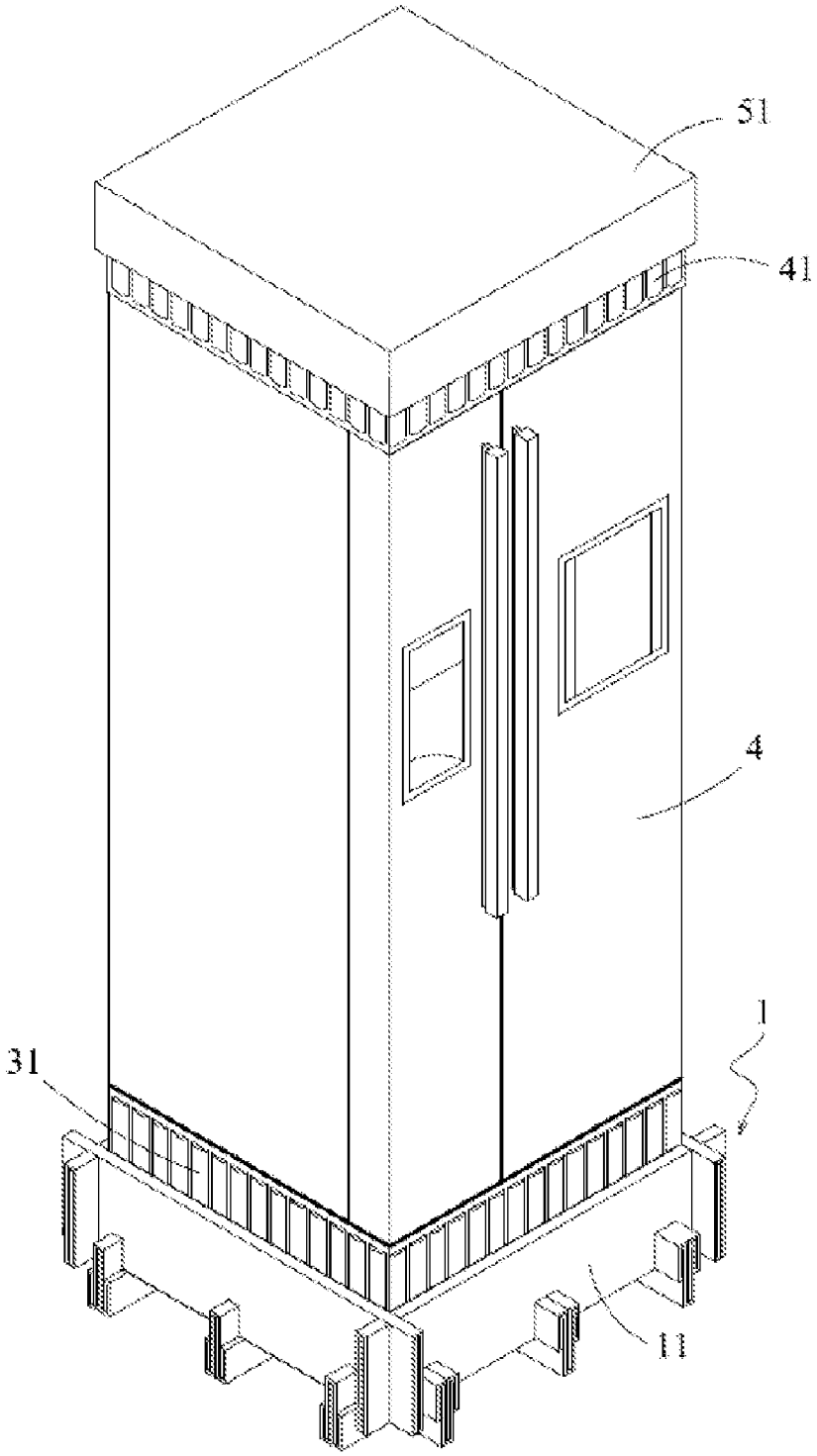
FIG. 5 is an operational view of the present invention.

Please refer to FIGS. 1 and 5, showing a paper pallet for packaging provided by the present invention, which combines the traditional paper pallet with a packaging protective frame 102 and becomes a load bearing base for packaging the goods, so as to carry the goods being sold.

The paper pallet for packaging includes: a load bearing base 11, a packaging protective frame 102 and a plurality of protective packaging material 31. Please refer to FIGS. 1 and 2, wherein the load bearing base 11 has a plurality of vertical supporting components 111 and a plurality of horizontal supporting components 112, which are formed by a single folded corrugated cardboard, wherein the vertical supporting components 111 and the horizontal supporting components 112 are arranged in a net grid layout to form at least one intersection point. At the intersection point(s), a plurality of first grooves 1111 are set on the vertical supporting components 111 which are relative to the plurality of second grooves 1121 set on the horizontal supporting components 112. Thus the vertical supporting components 111 are inlaid on the horizontal supporting components 112, which form a load bearing base through the intersection and subsequent interlocking of these first grooves 1111 and second grooves 1121. The packaging protective frame 102 is inlaid on the load bearing base at a set distance from the edge of the load bearing base 11, which has a plurality of side plates 113 arranged in a box-shape and assembled at a set distance from the edge of the load bearing base 11, where the plurality of side plates 113 set a plurality of third grooves 1131 at a third intersection point for inlaying on each other so as to form the packaging protective frame 102, which sets a plurality of fourth grooves 1132 at a fourth intersection point for inlaying on the edge of the load bearing base 11 to form the paper pallet for packaging 1.

Please refer to FIG. 5, the packaging protective frame 102 is inlaid on the load bearing base 11 and forms a space for placing and carrying a cargo 4 (such as: refrigerator). The protective packaging material 31 is set between the packaging protective frame 102 and the cargo 4 to fill the gap between them and strengthen the protection of the cargo 4.

The height of the side plates 113 of the packaging protective frame 102 can be adjusted according to the height of the cargo 4 for delivering. That is, when higher/lower packaging is needed for cargo 4, the single corrugated cardboard side plates 113 of the packaging protective frame 102 can be folded/unfolded to become higher/lower side plates 113 to form the higher/lower packaging protective frame 102 for higher/lower packaging of cargo 4.

The height of the protective packaging material 31 can be adjusted according to the height of the cargo 4 for delivering, and extends upward to cover and surround the entire cargo 4, and can also be adjusted higher or lower according to the height of the side plates 113 of the packaging protective frame 102. Thus, the protective packaging material 31 can be used to fill the gap between the packaging protective frame 102 and the cargo 4, or extend upwards to cover and surround the entire cargo 4.

The paper pallet for packaging 1 is formed by combining the packaging protective frame 102 with the load bearing base 11, which becomes a packing box for packaging the large cargo 4 when delivering. The paper pallet is used as the load bearing base 11 for packing goods, which replaces Styrofoam plate, wooden material and metal frames, has the advantages of a low manufacturing cost, light weight, no pests, etc., and can be fully recycled and is environmentally friendly.

Additionally, the protective packaging material 31 can be a plastic inflatable bag filled with air, so that the protective packaging material 31 is flexible, which helps to cushion the impact when moving the cargo (as shown in FIG. 5).

The paper pallet for packaging 1 further includes a cover 51 for covering the top of the cargo 4. The protective packaging material 41 is placed in the gap between the cover 51 and the cargo 4 to protect the top 41 of the cargo 4 from the damage caused by a collision (as shown in FIG. 5).

Figure 3:
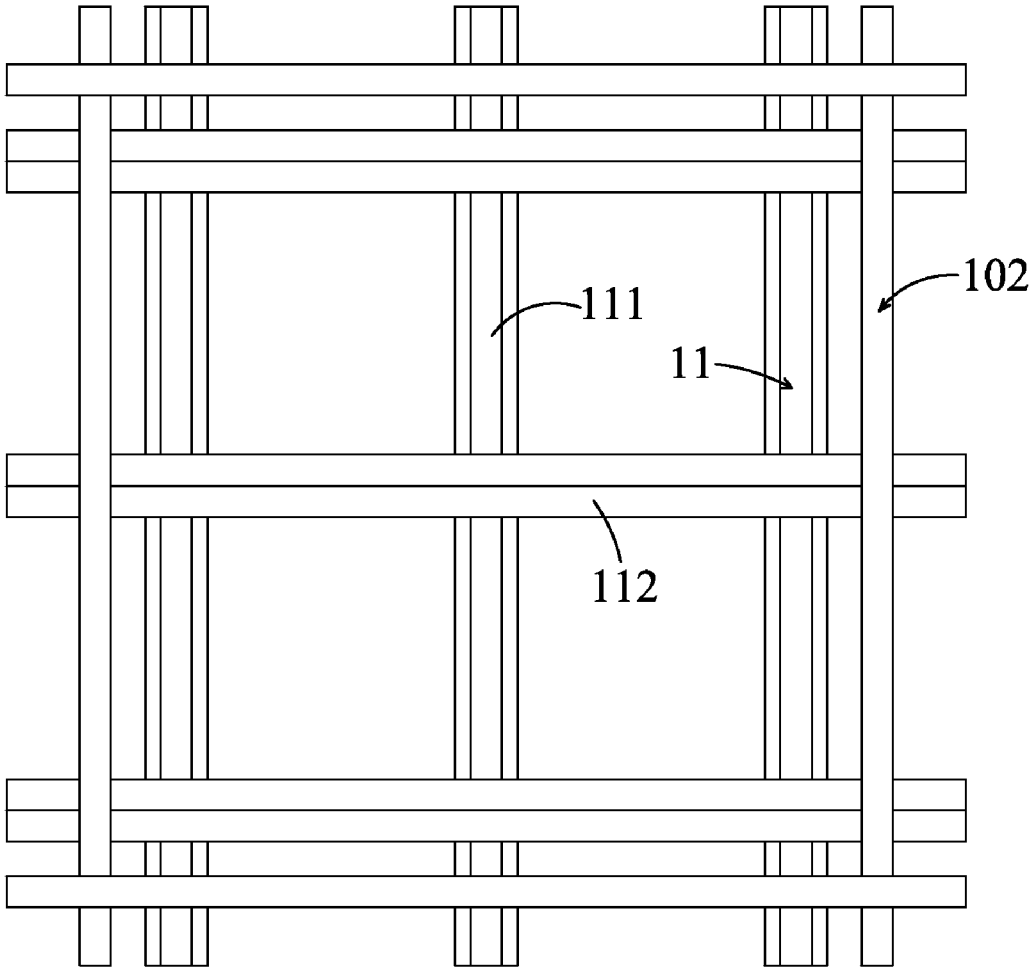
FIG. 3 is a top plan view of the present invention.
Figure 4:
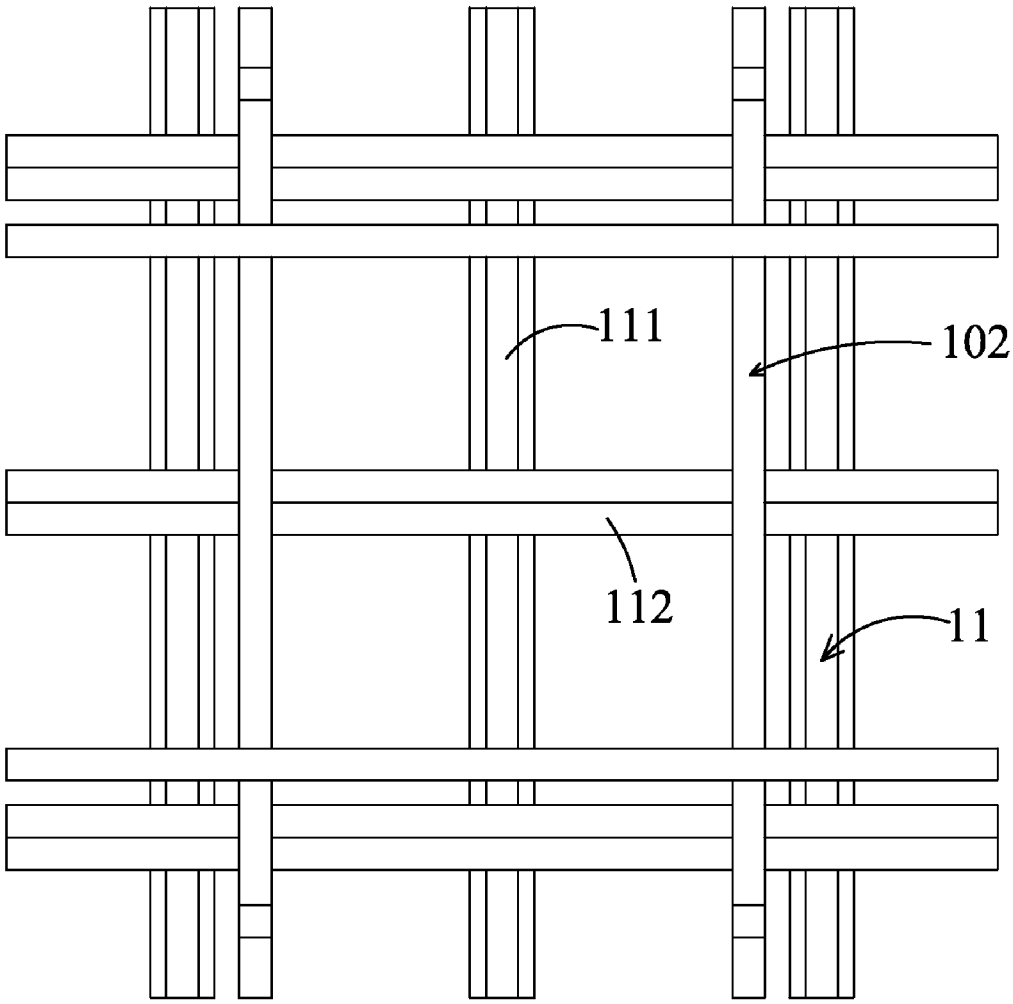
FIG. 4 is another top plan view of the present invention.

Please refer to FIGS. 3 and 4. The packaging protective frame 102 can be inlaid on the load bearing base at a set distance from the edge of the load bearing base. (as shown in FIG. 3) The packaging protective frame 102 also can be inlaid at another set distance from the edge of the outmost intersection point of the vertical supporting components and the horizontal supporting components of the load bearing base 11. (as shown in FIG. 4)

Figure 6:
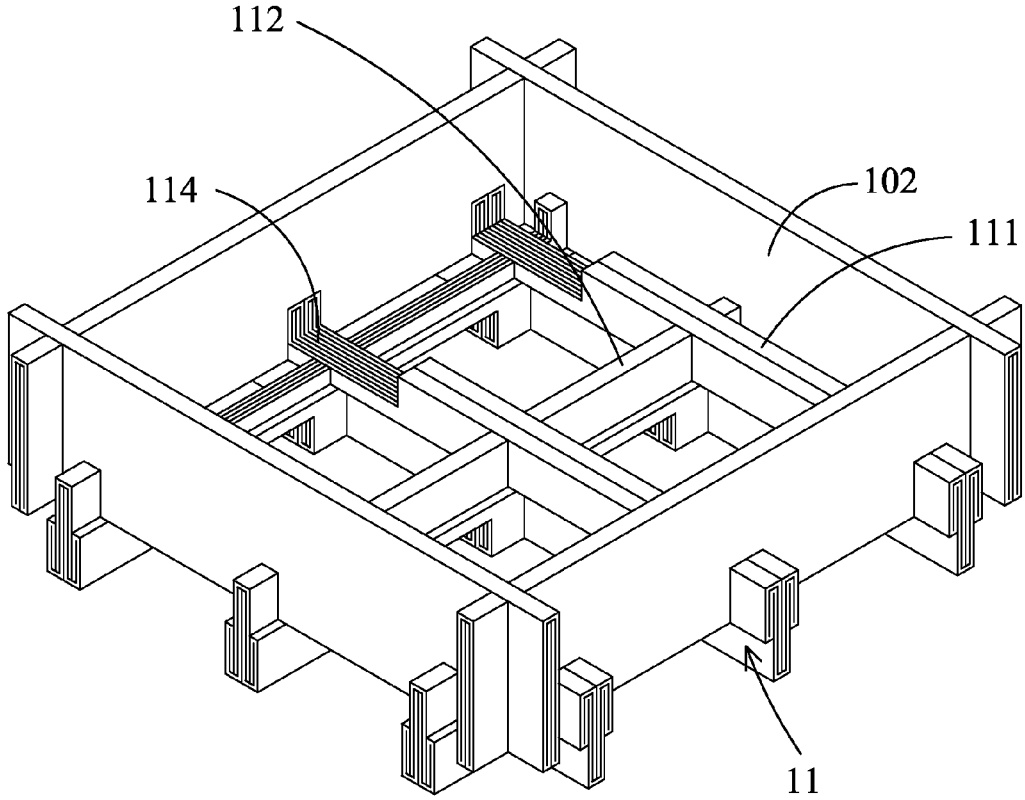
FIG. 6 is a perspective view showing an embodiment of the present invention.

Please refer to FIG. 6. The vertical supporting components 111 and the horizontal supporting components 112 of the load bearing base 11 have at least one indent 114 corresponding to a bottom shape of a various cargo 4, so that the cargo 4 with a bulge at the bottom can be installed smoothly on the load bearing base 11.

Figure 2:
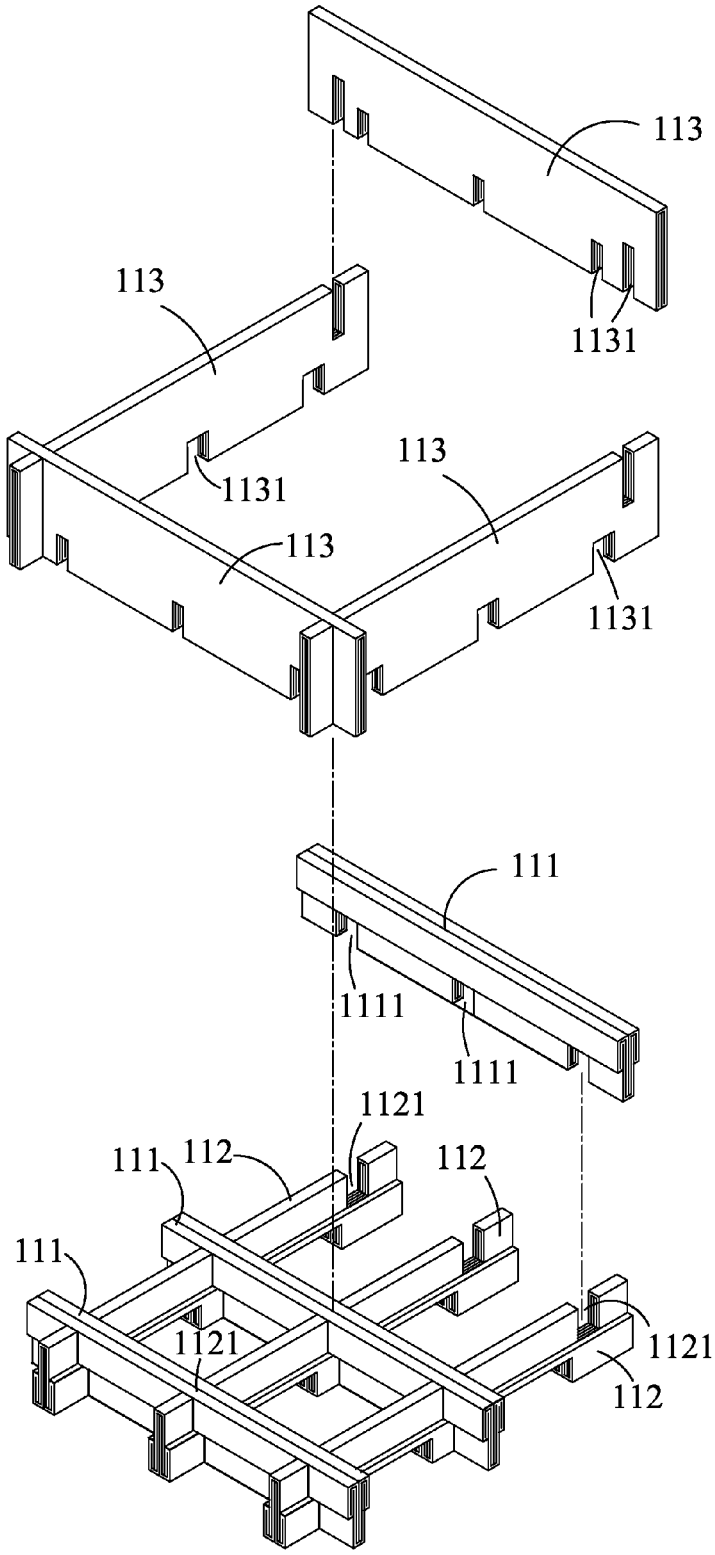
FIG. 2 is an exploded perspective view of the present invention.

Please refer to FIGS. 1 and 2. the vertical supporting components 111 and the horizontal supporting components 112 are formed by a single folded corrugated board, where both sides of the corrugated board are folded to the middle, the corrugated board being folded according to the center line thereof, each side of the corrugated board bending and folding outward respectively, and forming a thickened T-shaped cross section structure at the top.

Figure 7:
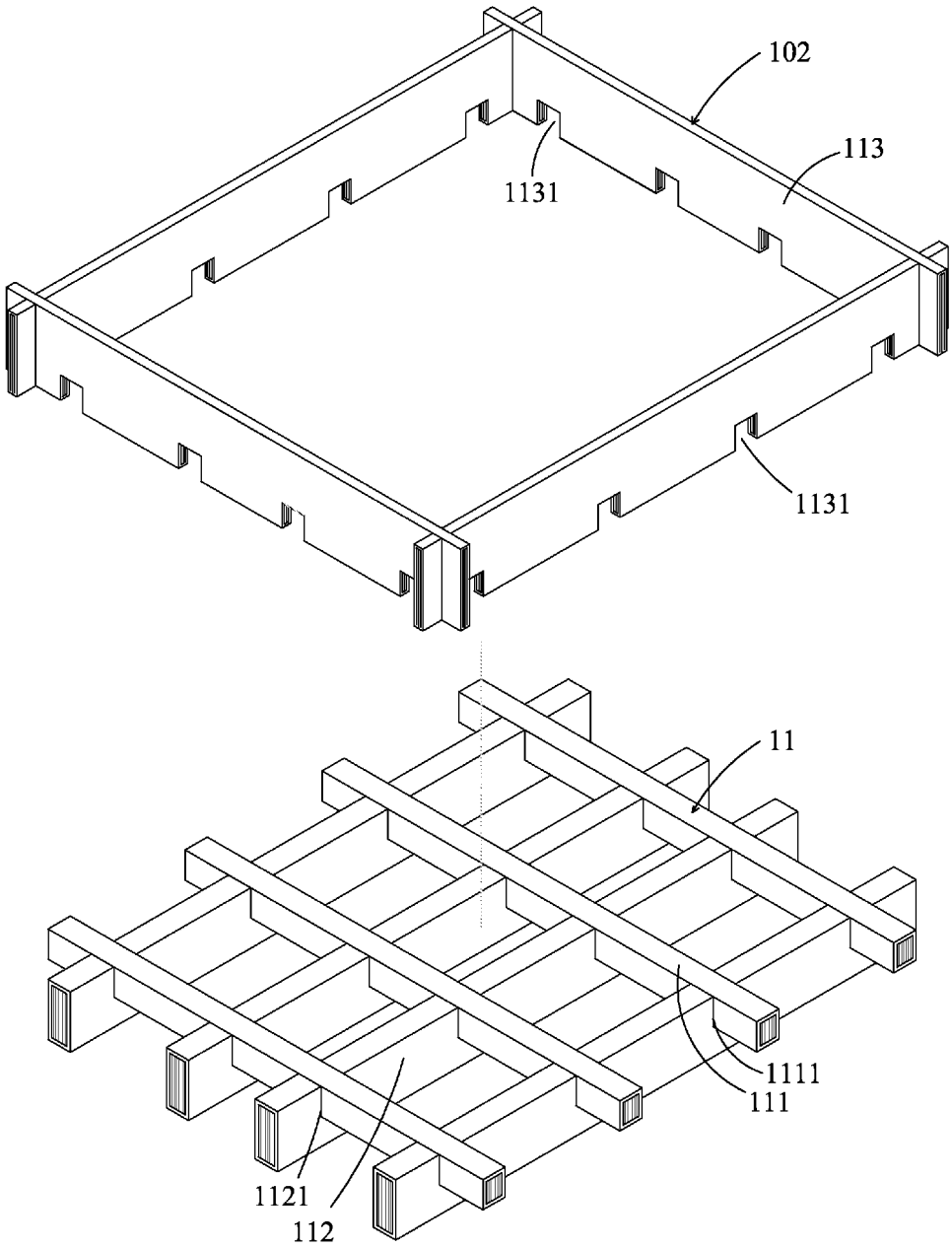
FIG. 7 is a perspective view showing another embodiment of the present invention.

Please refer to FIG. 7, which is another embodiment of the present invention. The load bearing base 11 can be any type of paper pallet, wherein the vertical supporting components 111 and the horizontal supporting components 112 are bound by a plurality of corrugated boards to form two concentric shapes when viewed from a cross section. The vertical supporting components 111 and the horizontal supporting components 112 are arranged in a net grid layout to form at least one intersection point. At the intersection point(s), a plurality of first grooves 1111 are set on the vertical supporting components 111 which are relative to the plurality of second grooves 1121 set on the horizontal supporting components 112. Thus the vertical supporting components 111 are inlaid on the horizontal supporting components 112, which form a load bearing base through the intersection and subsequent interlocking of these first grooves 1111 and second grooves 1121. The packaging protective frame 102 is inlaid at a set distance from the edge of the load bearing base 11, the package protective frame 102 has a plurality of side plates 113 arranged in a box-shape and assembled at a set distance from the edge of the load bearing base 11, where the plurality of side plates 113 set a plurality of third grooves 1131 at a third intersection point for inlaying on each other so as to form the packaging protective frame 102, which sets a plurality of fourth grooves 1132 at a fourth intersection point for inlaying on the edge of the load bearing base 11 to form the paper pallet for packaging 1.

Figure 8:
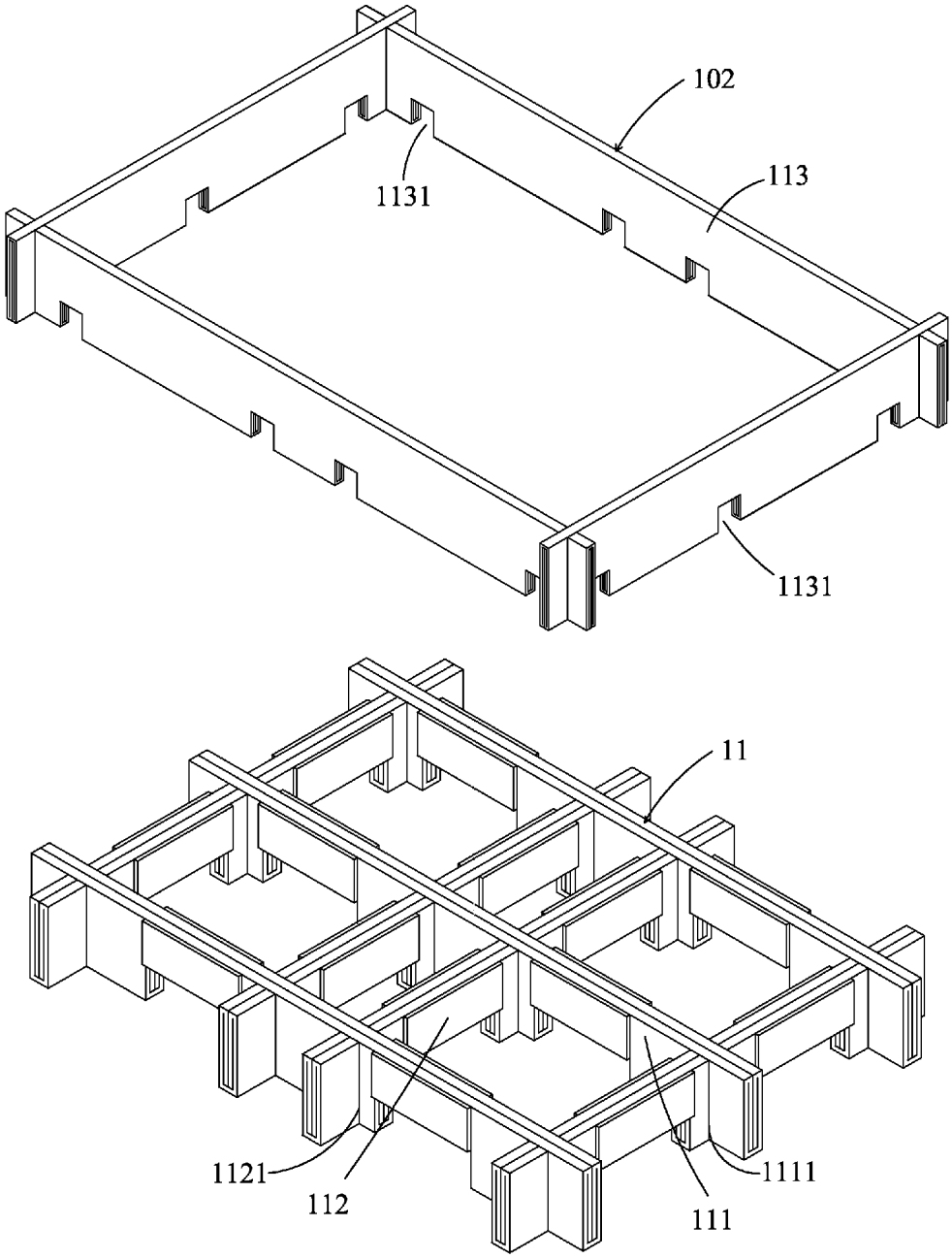
FIG. 8 is a perspective view showing an additional embodiment of the present invention.

Please refer to FIG. 8, which is another additional embodiment of the present invention. The load bearing base 11 can be any type of paper pallet. Wherein the vertical supporting components 111 and the horizontal supporting components 112 are formed by a single folded corrugated board, where both sides of the corrugated board are folded to the middle, the corrugated board being folded according to the center line thereof, and forming a structure with increased thickness.

The vertical supporting components 111 and the horizontal supporting components 112 are arranged in a net grid layout to form at least one intersection point. At the intersection point(s), a plurality of first grooves 1111 are set on the vertical supporting components 111 which are relative to the plurality of second grooves 1121 set on the horizontal supporting components 112. Thus the vertical supporting components 111 are inlaid on the horizontal supporting components 112, which form a load bearing base through the intersection and subsequent interlocking of these first grooves 1111 and second grooves 1121. The packaging protective frame 102 is inlaid at a set distance from the edge of the load bearing base 11, which has a plurality of side plates 113 arranged in a box-shape and assembled at a set distance from the load bearing base 11, where the plurality of side plates 113 set a plurality of third grooves 1131 at a third intersection point for inlaying on each other so as to form the packaging protective frame 102, which sets a plurality of fourth grooves 1132 at a fourth intersection point for inlaying at a set distance from the edge of the load bearing base 11 to form the paper pallet for packaging 1.

The bottom of the cargo 4 being sold is placed in the packaging protective frame 102 of the load bearing base 11 when packaging. Then, the plurality of protective packaging materials 31 are placed between the packaging protective frame 102 and the cargo 4 for delivery. Then, the cover 51 is put on the top of the cargo 4 and the protective packaging material 41 is placed into the gap between them. Thus, the packaging for the cargo 4 is complete.

When comparing with the aforementioned conventional technology, the paper pallet for packaging provided by the present invention has the following advantages:

1. The paper pallet used as the load bearing base for packing goods, which replaces Styrofoam plate, wooden material and metal frames, has the advantages of a low manufacturing cost, light weight, no pests, etc., and can be fully recycled and is environmentally friendly.

2. That combining the packaging protective frame and paper pallet will remove the traditional labor intensive action needed to provide outside packaging for the goods, and thus increase the protective capacity.

3. Better protective effect can be achieved by combining the protective packaging material.

4. Packing is easy and cost for using is low.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A paper pallet for packaging, comprising a load bearing base, constructed from a plurality of vertical supporting components and a plurality of horizontal supporting components being inlaid on each other, a plurality of first grooves are set at the first intersection points where the plurality of vertical supporting components and the horizontal supporting components intersect, a plurality of second grooves are set relative to the plurality of first grooves at the second intersection points where the vertical supporting component and the horizontal supporting components intersect, and the plurality of first grooves and the plurality of second grooves intersect and subsequently interlock to form the load bearing base, characterized in that:

a packaging protective frame inlaid at a first set distance from the edge of the load bearing base, the packaging protective frame has a plurality of side plates arranged in a box shape and assembled at the first set distance from the edge of the load bearing base, where the plurality of side plates sets a plurality of third grooves at a third intersection point for being inlaid on each other so as to form the packaging protective frame, which sets a plurality of fourth grooves at a fourth intersection point for inlaying at the first set distance from the edge of the load bearing base to form the paper pallet for packaging.

2. The paper pallet for packaging as claimed in claim 1, wherein the packaging protective frame is inlaid on the load bearing base and forms a space for placing and carrying a cargo, and a plurality of protective packaging material further being placed between the packaging protective frame and the cargo.

3. The paper pallet for packaging as claimed in claim 2, wherein the protective packaging material is a plastic inflatable bag full of air.

4. The paper pallet for packaging as claimed in claim 2, wherein the paper pallet for packaging further comprises a cover for covering a top of the cargo, and the protective packaging material fills the gap between the cover and the top of the cargo.

5. The paper pallet for packaging as claimed in claim 2, wherein the vertical supporting components and horizontal supporting components of the load bearing base have at least one indent corresponding to a bottom shape of a various cargo.

6. The paper pallet for packaging as claimed in claim 1, wherein the packaging protective frame is inlaid at the first set distance from the edge of the outmost intersection point of the vertical supporting components and the horizontal supporting components of the load bearing base.

7. The paper pallet for packaging as claimed in claim 1, wherein the packaging protective frame is inlaid at a second set distance from the edge of the outmost intersection point of the vertical supporting components and the horizontal supporting components of the load bearing base.

8. The paper pallet for packaging as claimed in claim 1, wherein the vertical supporting components and the horizontal supporting components are formed by a single folded corrugated board, where both sides of the corrugated board are folded to the middle, the corrugated board being folded according to the center line thereof, each side of the corrugated board bending and folding outward respectively, and forming a thickened T-shaped cross section structure at the top.

* * * * *